US007793724B2

(12) United States Patent
Daniel et al.

(10) Patent No.: US 7,793,724 B2
(45) Date of Patent: Sep. 14, 2010

(54) SUBSEA MANIFOLD SYSTEM

(75) Inventors: Jeremiah Daniel, Houston, TX (US); James E. Dailey, Spring, TX (US)

(73) Assignee: Chevron U.S.A Inc., San Ramon, CA (US)

( * ) Notice: Subject to any disclaimer, the term of this patent is extended or adjusted under 35 U.S.C. 154(b) by 0 days.

(21) Appl. No.: 11/567,637

(22) Filed: Dec. 6, 2006

(65) Prior Publication Data

US 2008/0135256 A1 Jun. 12, 2008

(51) Int. Cl.
*E21B 43/01* (2006.01)

(52) U.S. Cl. ..... 166/366; 166/367; 166/368; 166/350; 166/352; 405/224.2; 405/224.3

(58) Field of Classification Search ..... 166/366–369, 166/359, 350–352; 405/224.2–224.4
See application file for complete search history.

(56) References Cited

U.S. PATENT DOCUMENTS 3,602,302 A 8/1971 Kluth
3,855,656 A 12/1974 Blenkarn
3,874,415 A 4/1975 Pierce et al.
4,436,048 A 3/1984 Gentry et al.
4,448,568 A * 5/1984 Gentry et al. ..... 405/168.3
4,478,586 A * 10/1984 Gentry et al. ..... 441/4
4,502,551 A 3/1985 Rule et al.
4,523,602 A 6/1985 Snyder
4,765,378 A 8/1988 Engelskirchen et al.
5,041,038 A * 8/1991 Poldervaart et al. ..... 441/5
5,275,510 A * 1/1994 de Baan et al. ..... 405/171
5,335,730 A 8/1994 Cotham, III
5,456,622 A * 10/1995 Breivik et al. ..... 441/3
5,515,803 A * 5/1996 Korsgaard ..... 114/230.13
5,697,732 A 12/1997 Sigmundstad
5,878,814 A 3/1999 Breivik et al.
5,895,077 A 4/1999 Sigmundstad
5,983,931 A 11/1999 Ingebrigtsen et al.
6,003,603 A 12/1999 Breivik et al.
6,021,848 A 2/2000 Breivik et al.
6,050,747 A 4/2000 Midttveit
6,053,787 A 4/2000 Erstad et al.
6,059,620 A 5/2000 Yetman
6,094,937 A 8/2000 Paurola et al.
6,193,574 B1 2/2001 Pollack
6,199,500 B1 * 3/2001 Børseth et al. ..... 114/230.12
6,220,787 B1 4/2001 Tanabe et al.
6,230,809 B1 5/2001 Korsgaard
6,257,801 B1 * 7/2001 Kelm et al. ..... 405/224.2
6,772,840 B2 * 8/2004 Headworth ..... 166/302
6,811,355 B2 * 11/2004 Poldervaart ..... 405/169
6,845,727 B2 1/2005 Eide et al.
6,926,084 B2 8/2005 Erstad (Continued)

*Primary Examiner*—Thomas A Beach
*Assistant Examiner*—Matthew R Buck
(74) *Attorney, Agent, or Firm*—Merchant & Gould

(57) ABSTRACT

An improved subsea manifold system that is capable of being used in an early production system for producing hydrocarbons from a plurality of wells from a common riser system. The subsea manifold is able to control the fluid from a multiple of subsea wet-tree wells while at the same time giving the operator the option to isolate production from a single subsea well for production evaluation. The subsea manifold also includes a pigging loop which enables efficient pigging of the flowline(s) of the early production system.

34 Claims, 2 Drawing Sheets

U.S. PATENT DOCUMENTS

| | | | | |
|---|---|---|---|---|
| 6,968,899 | B1 | 11/2005 | Poldervaart et al. | |
| 7,073,593 | B2 * | 7/2006 | Hatton et al. | 166/367 |
| 7,093,661 | B2 * | 8/2006 | Olsen | 166/357 |
| 7,434,624 | B2 * | 10/2008 | Wilson | 166/368 |
| 2003/0056954 | A1 * | 3/2003 | Headworth | 166/302 |
| 2003/0099517 | A1 | 5/2003 | Poldervaart | |
| 2003/0138299 | A1 | 7/2003 | Eide et al. | |
| 2004/0042856 | A1 | 3/2004 | Erstad | |
| 2004/0076478 | A1 * | 4/2004 | Legras et al. | 405/224.2 |
| 2004/0144543 | A1 * | 7/2004 | Appleford et al. | 166/336 |
| 2005/0145388 | A1 * | 7/2005 | Hopper | 166/357 |
| 2006/0243328 | A1 | 11/2006 | Bessmertny | |
| 2007/0095427 | A1 | 5/2007 | Ehrhardt et al. | |
| 2007/0155259 | A1 | 7/2007 | Van Tol et al. | |
| 2008/0135258 | A1 | 6/2008 | Daniel | |
| 2008/0138159 | A1 | 6/2008 | Daniel | |
| 2008/0140337 | A1 | 6/2008 | Daniel | |

* cited by examiner

SUBSEA MANIFOLD SYSTEM

TECHNICAL FIELD

This invention relates to a subsea manifold system that is utilized in the production of hydrocarbons from marine oil and gas deposits. In particular, it relates to a subsea manifold which is capable of being used in an early production system for producing hydrocarbons from a plurality of subsea wells through a common riser system.

BACKGROUND OF THE INVENTION

In the production of hydrocarbons from marine oil and gas deposits, a fluid communication system from the sea floor to the surface is required. Such a system usually includes multiple conduits through which various fluids flow between a subsea well or pipeline to a surface facility. The multiple conduits for communicating with a surface facility typically include subsea trees, manifolds, production and export flowlines, buoys and riser systems.

One method for producing hydrocarbons from marine oil fields is to use a fixed facility attached to the seafloor, however, known fixed facilities can be enormously expensive, and this is especially true for the development of deepwater production facilities. A deepwater discovery prospect may have the potential to justify full field development which would include the development of a dry-tree completion unit, such as a spar. However, evaluation of such a prospect must be carefully managed. Care must be taken so as to minimize the drilling of unnecessary and/or unproductive wells. In deepwater production, drilling costs are becoming so large that the cost of the subsea wells themselves may comprise substantially more than half of the total cost of deepwater development. Further, reservoir performance characteristics cannot be predicted with certainty, this is especially true in frontier provinces where there is little or no previous operating experience in that region.

To offset some of the costs associated with a deepwater discovery prospect, an Early Production System ("EPS") can be initially used. Using an EPS, an operator can begin to gain field operating knowledge while at the same time generating revenue to amortize investment from the early production of hydrocarbons from the prospect. An EPS can be expected to produce from a wet-tree well system on the seafloor. Should the use of the EPS show that full field development is desirable, it may be technically and economically attractive to preserve the productive capacity of the wet-tree well system through the adaptation to a dry-tree well system or vertical access service. The economics of full field development may require that a drilling or workover rig be positioned on the production platform to reduce field development costs. The drilling or workover rig can be used to drill new wells, to work over existing wells, or to even to maintain submersible pumps.

The advantage of utilizing an EPS is that a limited number of subsea wells can be drilled to delineate a prospective discovery, and these wells can be produced for a time frame on the order of months to years to quantify reservoir performance characteristics. Depending on the prospect, the wells may be widely dispersed and drilled vertically or they may be clustered in a "drill center" and drilled directionally. A drill center has the advantage that the wells can be manifolded and tied back to a host vessel by a pair of flowlines and risers to form a round-trip pigging loop ("pigging loop"). Wet-trees from a subsea drill center are positioned to be compatible with the seafloor well pattern for a dry-tree production unit such as a spar. One example of a wet-tree well pattern is a square with 50 feet of separation between the wells. A drill center can then use the wells positioned along one or more sides of the square for production. Alternatively, the wells can be in clusters that are positioned so that the dry-tree unit can be moved using its mooring system to reach over the wells for working over the old wells, drilling wells, or even for well maintenance such as submersible pump replacement.

It is an object of the present invention to provide a low cost subsea manifold that can be used with an EPS to produce, maintain and/or workover multiple subsea wet-tree wells through a common riser system. It is also a further object of the present invention that the subsea manifold be able to control the fluid from a multiple of subsea wet-tree wells while at the same time giving the operator the option to isolate production from a single subsea well for production evaluation. It is an additionally object of the present invention to control the direction of flow of fluid in the subsea manifold.

It is an objection of the present invention to provide a manifold that allows for efficient pigging of a first flowline or of a first and second flowline.

It is an object of the present invention to enable a wet-tree to be connected to a manifold by a jumper, wherein the manifold is connected to a bottom-founded, top-tensioned riser. The present invention will thereby allow for the production of hydrocarbons, well workover and well maintenance without disconnecting the riser.

SUMMARY OF THE INVENTION

The present invention is directed an improved subsea manifold system that is capable of being used in an early production system for producing hydrocarbons from a plurality of wells. In one embodiment of the present invention, the subsea manifold system controls the flow of fluid from a plurality of subsea wells to a common riser system. The subsea manifold system comprises two or more subsea trees, each subsea tree connected to a subsea well; a manifold connected to each of the subsea trees; and a first common riser having a first flowline connected to the manifold; wherein production, maintenance and /or workover of each subsea well is through the first common riser.

In another embodiment of the present invention, the subsea manifold includes a first flowline connected to a first common riser; at least one valve for controlling the flow of fluid in the first flowline; a plurality of jumpers connecting a plurality of subsea wells, each of the jumpers providing a fluid connection from a subsea well to the first flowline and having at least one jumper valve controlling the flow of fluid to or from the first flowline and a control device which operatively controls the position of each of the valves on each of the jumpers and the first flowline.

In another embodiment of the present invention a method is provided for producing hydrocarbons from a subsea well, the method comprising the step of producing fluids from two or more subsea trees through a first common riser having a first flowline, each subsea tree connected to a subsea well, wherein the fluids are produced through a manifold interconnecting the subsea trees and the first common riser.

Optionally, in some embodiments of the present invention, the subsea manifold system further includes a second common riser having a second flowline connected to the manifold. The first flowline and the second flowline can have distal ends that are connected to form a pigging loop. The manifold comprises one or more valves operatively connected to the first and second flowlines to control the flow of fluid through the pigging loop; two or more jumpers, each jumper interconnecting a subsea tree and the first flowline and the second flowline; one or more jumper valves for controlling the flow of fluid to or from the subsea trees to the first flowline and the second flowline; and the first common riser is anchored to the sea floor.

Optionally, in some embodiments of the present invention, the jumpers are arranged in a pattern that corresponds to a pattern of subsea wells. It should also be appreciated that the jumpers of the manifold can be arranged in a pattern that corresponds to a pattern of a set of subsea wells of the drill center.

In another embodiment of the present invention, the riser system connected to the subsea manifold is in a fluid connection to a disconnectable buoy capable of being operatively connected to a floating vessel.

In yet another embodiment of the present invention, the riser system connected to the subsea manifold is bottom-founded and top-tensioned.

Additional features and advantages of the present invention are described in, and will be apparent from, the following Detailed Description of the Invention and the Figures.

BRIEF DESCRIPTION OF THE DRAWINGS

These and other objects, features and advantages of the present invention will become better understood with regard to the following description, pending claims and accompanying drawings where:

Figure 1A:
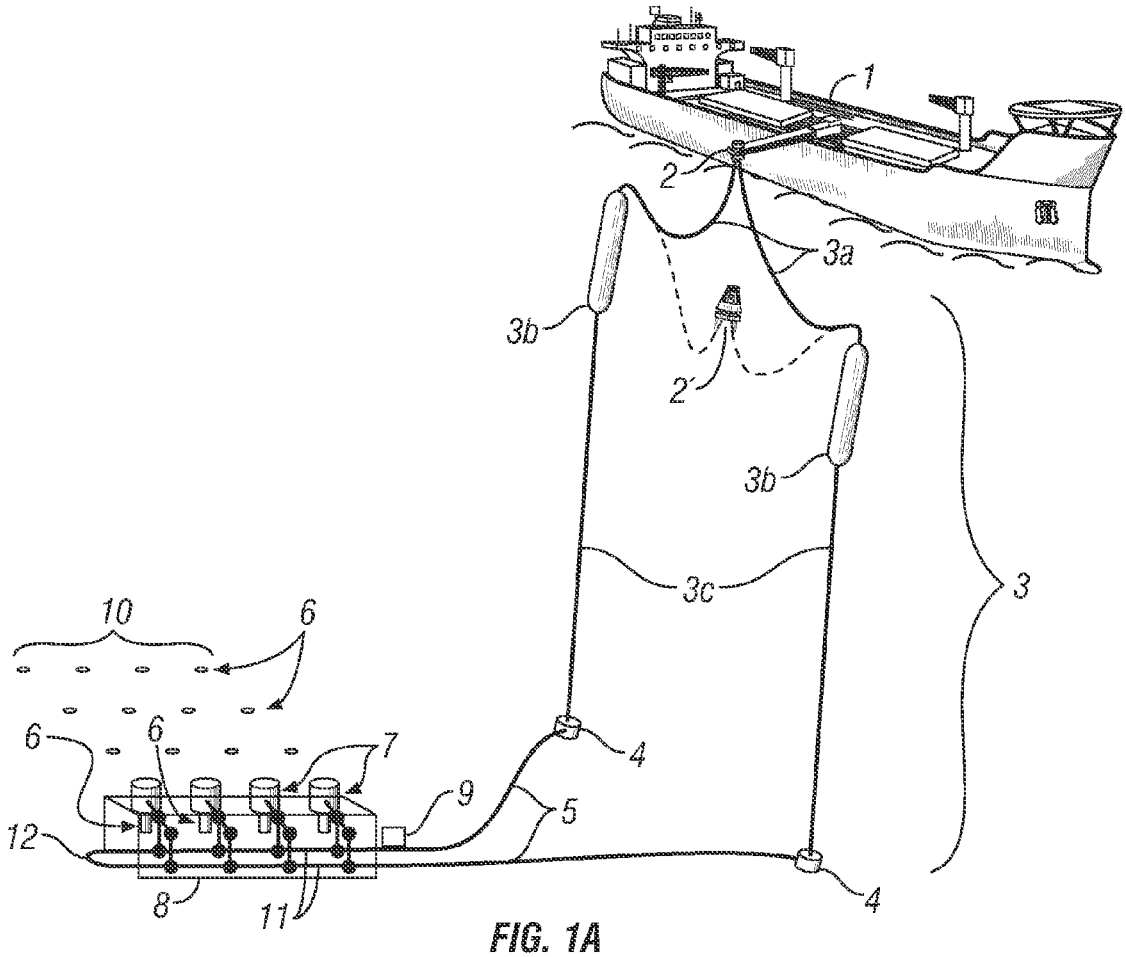
FIG. 1A is a schematic representation of an embodiment of an Early Production System and the subsea manifold system for transferring fluid between a well penetrating a subsurface formation beneath the seafloor and a vessel floating on the surface of the sea.

The invention will be described in connection with its preferred embodiments. However, to the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents which are included within the spirit and scope of the invention, as defined by the appended claims.

DETAILED DESCRIPTION OF THE INVENTION

While this invention is susceptible of embodiments in many different forms, there are shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

As described-above, the present invention includes a low cost subsea manifold system that can be used with an EPS for producing hydrocarbons from a plurality of wells from a common riser system. The subsea manifold system of the present invention is able to control the fluid from a multiple of subsea wells ("wet-tree") wells while at the same time giving the operator the option to isolate production from a single subsea well for production evaluation.

The term "downstream," as defined herein, refers to the flow of hydrocarbons in the direction of the equipment, facilities or systems located on the floating vessel. Conversely, "upstream," as defined herein, refers to equipment, facilities or systems located towards the producing reservoir.

The term "production flowline" or "flowline," as defined herein, is intended to refer to internal and external flowlines and piping such as within the manifold and external to the manifold.

An example of an EPS is shown in FIG. 1A, which illustrates a subsea manifold system for transferring fluid from a subsea well 6 penetrating a subsurface formation beneath the seafloor through a riser system to a vessel 1 floating on the surface of the sea. The riser system includes a disconnectable buoy 2 capable of connecting to a floating vessel 1. The disconnectable buoy 2 is connected to one or more common risers 3. Each common riser 3 can have a flexible jumper 3*a*, a riser buoy 3*b*, and a vertical riser portion 3*c*. The flexible jumper 3*a* is interconnecting the riser buoy 3*b* and the disconnectable buoy 2. The riser system provides for fluid communication between the disconnectable buoy 2 and at least one flowline 5 on the sea floor, which can be connected to a least one subsea well 6. The common risers 3 may be steel catenary risers or flexible risers with single or multiple flowlines, hybrid risers, or bottom founded and top tensioned risers, depending on the characteristics of the production system.

The vessel 1 floating on the surface of the sea can be any floating facility that can receive, process, store or export hydrocarbons, and is capable of disconnecting from the riser system. In the embodiment shown in FIG. 1A, the floating vessel 1 is capable of disconnecting from the riser system at the disconnectable buoy 2. Typical floating facilities or vessels that can be used include, but are not limited to floating production and offloading (FPSO) vessels, barges, articulated barges, semi-submersible rigs and ships.

In the EPS embodiment shown in FIG. 1A, the disconnectable buoy 2 is the connection point between the common risers 3 and the floating vessel 1. The disconnectable buoy 2 will incorporate the required buoyancy and ballast system to ensure the disconnectable buoy 2 will float at sea level or at a predetermined depth below the surface of the water when it is disconnected from the floating facility 1. When disconnected from the floating vessel 1, the disconnectable buoy is referenced as 2' in its disconnected position and is horizontally balanced between the risers 3 by the flexible jumpers 3*a* as indicated by the dashed lines.

Figure 1B:
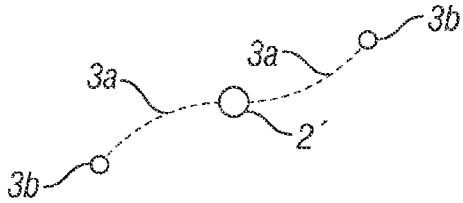
FIG. 1B is a top view of portions of a disconnectable buoy disconnected from a floating vessel in a horizontally balanced position between a plurality of risers.

In the embodiment illustrated in FIG. 1B, a plurality of two hybrid risers 3 is used to hold a disconnected buoy 2' in a horizontally balanced position. Specifically, FIG. 1B shows a top view of a disconnectable buoy 2' disconnected from the floating vessel 1 and being held in a horizontally balanced position between the hybrid risers 3. Disconnectable buoy 2' is horizontally balanced between the hybrid riser buoys 3 by flexible jumpers 3*a* as indicated by the dashed lines.

There are a number of existing turret buoys and disconnectable turret systems suitable for use in the present invention, such as those manufactured by Advanced Production and Loading AS, FMC SOFEC, Single Buoy Mooring Inc, and as described in applicants' co-pending U.S. Patent Application to Jeremiah Daniel, et al., titled Marine Riser System, Ser. No. 11/567,649, filed concurrently herewith on Dec. 6, 2006, which is incorporated by reference herein.

Each common riser 3 can be secured to the seafloor with anchor 4. A flowline 5 is connected to a lower portion 3*c* of each common riser 3 and to subsea wells 6 through respective subsea trees 7, for providing fluid communication between the riser 3 and the subsea wells 6.

FIG. 1A also shows an embodiment of the present invention wherein a subsea manifold 8 is utilized within the EPS to interconnect flowline 5 and subsea wells 6 for controlling flow to or from the subsea wells 6. The subsea manifold 8 of the present invention is preferably located on the sea floor near at least one subsea well 6. The subsea manifold 8 is capable of accumulating and co-mingling the production from two or more subsea trees 7 and their associated subsea wells 6. The subsea manifold 8 of the present invention is able to direct or redirect production flow from subsea wells 6, producing to the floating vessel 1 through a first flowline 5 connected to a first common riser (not shown), or alternatively through first and second flowlines 5 and first and second common risers as shown in FIG. 1A.

The subsea manifold 8 is preferably used with subsea wells 6 that have been drilled for use with a drill center (not shown) wherein the subsea wells 6 are drilled in a pattern and the manifold jumpers are arranged in a pattern that corresponds to the pattern of subsea wells. In FIG. 1A the group of subsea wells 10 are drilled in square, wherein the manifold 8 is connected to a set of wells 6 of the group of subsea wells 10. As development of the field progresses, it should be appreciated that different sets of subsea wells 6 from the group of subsea wells 10 could be connected to the manifold without prolonged disruption of production. For example, producing wells 6 that are connected to the manifold 8 will not have to disconnected or have production disrupted as different 6 wells are being serviced or connected to the subsea manifold 8. The present invention will allow the operator to isolate producing wells 6 while other wells 6 in the field are being reworked. It should be also be appreciated that the present invention can be sized to be connected to all the wells 6 in the drill center.

Figure 2A:
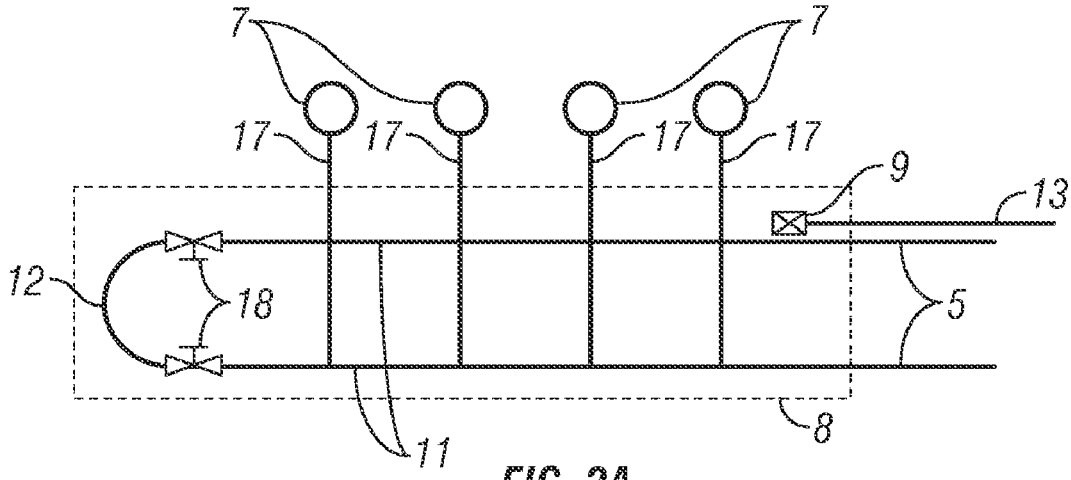
FIG. 2A is a top view schematic representation of a subsea manifold of the present invention.

FIG. 2A is a top view schematic representation of a subsea manifold 8 of the present invention. The flowlines 5 from a first and second common riser have distal ends that are connected upstream and/or downstream of the subsea wells to form a pigging loop 12. Alternatively, when only one common riser is used, the flowline 5 from the first common riser can be configured to form a pigging loop or a pig sending/receiving unit may be used. As illustrated, a pigging loop can also be formed by connecting the distal ends of first and second flowlines that are connected to first and second common risers. The pigging loop 12 formed by the manifold 8, the common risers 3, and the flowlines 5 will facilitate passing a pig from the floating vessel 1 through the subsea manifold system to be returned to the floating vessel 1.

When the disconnectable buoy 2 is connected to the floating vessel 1 hydrocarbons may be produced from the subsea wells 6 to the floating vessel 1 through the subsea manifold system described.

Figure 2B:
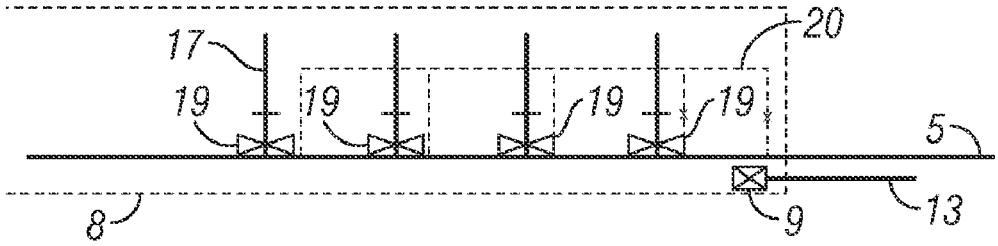
FIG. 2B is a side view schematic representation of the subsea manifold of FIG. 2A.
Figure 2C:
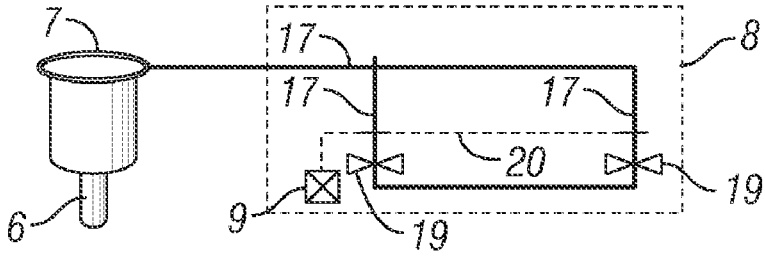
FIG. 2C is an end view schematic representation of the subsea manifold of FIG. 2A.

The outer boundary of subsea manifold 8 is indicated by a dashed line in FIGS. 2A, 2B and 2C. In the preferred embodiment of the present invention, the subsea trees 7 are in fluid communication with the manifold 8 through jumpers 17. The subsea manifold 8 interconnects the flowline 5 and subsea trees 7, for controlling fluid flows to or from the subsea wells 6. The flowlines 5 are interconnected upstream or downstream of the subsea wells within the manifold 8 to form a pigging loop 12 between the common risers 3, flowlines 5 and manifold 8. Valves 18 are included to control the flow of fluids through the pigging loop of the subsea manifold 8. The umbilicals 13 connect the floating vessel 1 to the control device 9 to provide a means for controlling the manifold 8, subsea trees 7 and valves.

FIG. 2B is a side view of the components of FIG. 2A. Referring to FIG. 2B, the subsea manifold 8 can isolate at least one well 6 through a jumper valve arrangement 19. The subsea manifold 8 includes jumpers 17 for interconnecting the subsea trees 7 and a first flowline before the pigging loop and a second flowline after the pigging loop. The control device 9 controls the position of jumper valves 19 as indicated by dashed line 20.

FIG. 2C is an end view of the components of FIG. 2A. Referring to FIG. 2C, the subsea wells 6 are in fluid communication with the manifold 8 through a subsea tree 7 and associated jumper 17. The jumpers 17 are connected to the flowlines 5 in two places, before and after the pigging loop 12. Jumper valves 19 connected to the flowlines 5 within the manifold to control flow to or from jumpers 17. It should be understood that each of the valves 18, and jumper valves 19 described herein include an associated actuator (not shown) for actuating the valves 18 and jumper valves 19.

A subsea tree or wet-tree 7, typically containing control valves, may be positioned on top of the subsea wellhead housing for providing means for controlling production from the well. The subsea tree 7 can also have a choke, various monitors and flow measuring devices and shut down valves. The subsea tree 7 has a production outlet, also known as a jumper 17, which connects the subsea tree 7 to subsea components, such as a manifold 8, that may be some distance away. The jumpers 17 between the various components on the sea floor are typically rigid steel pipes. As described-above, an umbilical 13 extends between the floating vessel 1 and a control device or station 9 located on the seafloor to operate the subsea components, including the various subsea trees 7.

Because of the plurality of connections between each of the subsea wells 6 and the pigging loop within the manifold 8, and the use of the plurality of valves 18 and jumper valves 19, the flow of fluid and the direction of flow can be changed in a number of different ways. For example, one subsea well 6 can be isolated on the first flowline 5 before the pigging loop 12 within the manifold 8, while another well or a plurality of wells can remain producing on the second flowline after the pigging loop 12. Different combinations of wells 6 could be evaluated in this manner. More importantly, because of the manner in which the jumpers 17 are connected to the flowline 5 of the manifold, wells 6 can be disconnected for service or changed without any disruption in production.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

What we claim is:

1. A subsea manifold system for producing hydrocarbons from a subsea well, the system comprising:

a) two or more subsea trees, each subsea tree connected to a subsea well;

b) a manifold connected to each of the subsea trees;

c) a first common riser having a first flowline connecting the manifold to a vertical riser portion of the first common riser, the first common riser further comprising a first hybrid riser buoy and a flexible jumper interconnecting the first hybrid riser buoy and a disconnectable buoy capable of connecting to a floating vessel; wherein production, maintenance and workover of each subsea well is through the first common riser; and d) a second common riser having a second flowline connected to the manifold, a second hybrid riser buoy and a flexible jumper interconnecting the second hybrid riser buoy of the second common riser and the disconnectable buoy;

wherein the flexible jumpers horizontally balance the disconnectable buoy between the first and second hybrid riser buoys within a balancing plane defined by the height of the first and second hybrid riser buoys.

2. The subsea manifold system of claim 1, wherein the first flowline forms a pigging loop, wherein each end of the first flowline is connected to the first common riser.

3. The subsea manifold system of claim 1, further comprising a pig sending and receiving unit connected to the first flowline at an end opposite the first common riser.

4. The subsea manifold system of claim 1, wherein the first flowline and the second flowline have distal ends that are connected to form a pigging loop.

5. The subsea manifold system of claim 4, wherein the manifold comprises one or more valves operatively connected to the first and second flowlines to control the flow of fluid through the pigging loop.

6. The subsea manifold system of claim 1, further comprising two or more jumpers, each jumper interconnecting a subsea tree and the first flowline.

7. The subsea manifold system of claim 1, wherein the manifold comprises one or more jumper valves for controlling the flow of a fluid to or from the subsea trees and the first flowline.

8. The subsea manifold system of claim 1, further comprising two or more jumpers, each jumper interconnecting a subsea tree and the first flowline and the second flowline.

9. The subsea manifold system of claim 8, wherein the manifold comprises one or more jumper valves for controlling the flow of fluid to or from the subsea trees to the first flowline and the second flowline.

10. The subsea manifold system of claim 5, 7, or 9, wherein the manifold comprises a control device for controlling the valves.

11. The subsea manifold system of claim 6 or 8, wherein the jumpers are arranged in a pattern that corresponds to a pattern of subsea wells.

12. The subsea manifold system of claim 1, wherein the first common riser is anchored to the sea floor such that the vertical riser portion of the first common riser is substantially vertical.

13. A subsea manifold for controlling the flow of fluid from a plurality of subsea wells to a riser system, the subsea manifold comprising:

a) two or more subsea trees, each subsea tree connected to a subsea well;

b) a first flowline for providing fluid communication between the subsea trees and a vertical riser portion of a first common riser, the first common riser further comprising a first hybrid riser buoy and a flexible jumper interconnecting the first hybrid riser buoy and a disconnectable buoy capable of connecting to a floating vessel;

c) a second common riser having a second flowline connected to the manifold, a second hybrid riser buoy and a flexible jumper interconnecting the second hybrid riser buoy of the second common riser and the disconnectable buoy;

d) at least one valve for controlling the flow of fluid in the first flowline;

e) a plurality of jumpers connecting the subsea trees to the first flowline;

f) at least one jumper valve operatively connected to each jumper for controlling the flow of fluid to or from the subsea trees to the first flowline; and g) a control device which operatively controls the position of the valves on each of the jumpers and the first flowline;

wherein the flexible jumpers horizontally balance the disconnectable buoy between the first and second hybrid riser buoys within a balancing plane defined by the height of the first and second hybrid riser buoys.

14. The subsea manifold of claim 13, wherein the first flowline forms a pigging loop, wherein each end of the first flowline is connected to the first common riser.

15. The subsea manifold of claim 13, further comprising a pig sending and receiving unit connected to the first flowline at an end opposite the first common riser.

16. The subsea manifold of claim 13 wherein the first flowline and the second flowline have distal ends that are connected to form a pigging loop.

17. The subsea manifold of claim 16, wherein the manifold comprises one or more valves operatively connected to the first and second flowlines to control the flow of fluid through the pigging loop.

18. The subsea manifold of claim 13, wherein the plurality of jumpers connect the subsea trees to the first flowline and the second flowline.

19. The subsea manifold of claim 13, wherein the jumper valves operatively connected to each jumper control the flow of fluid to or from the subsea trees to the first flowline and the second flowline.

20. The subsea manifold of claim 18 wherein the jumpers are arranged in a pattern that corresponds to a pattern of subsea wells.

21. The subsea manifold of claim 13, wherein the first common riser is anchored to the sea floor such that the vertical riser portion of the first common riser is substantially vertical.

22. The subsea manifold of claim 13, wherein the second common riser is anchored to the sea floor such that a vertical riser portion of the second common riser is substantially vertical.

23. The subsea manifold of claim 13 or 16, wherein the disconnectable buoy is connected to a floating vessel.

24. The subsea manifold of claim 13 or 14, wherein the riser is bottom-founded and top-tensioned.

25. A method of producing hydrocarbons from a subsea well connected to a subsea manifold, the method comprising the step of producing fluids from two or more subsea trees through a first common riser having a first flowline connected to a vertical riser portion of the first common riser, the first common riser further comprising a first hybrid riser buoy and a flexible jumper interconnecting the first hybrid riser buoy and a disconnectable buoy capable of connecting to a floating vessel, each subsea tree connected to a subsea well, wherein:

the fluids are produced through a manifold interconnecting the subsea trees and the first common riser, the subsea manifold further comprises a second common riser having a second flowline connected to the manifold, a second hybrid riser buoy and a flexible jumper interconnecting the second hybrid riser buoy of the second common riser and the disconnectable buoy; and the flexible jumpers horizontally balance the disconnectable buoy between the first and second hybrid riser buoys within a balancing plane between the first and second common risers wherein the balancing plane is defined by the height of the first and second hybrid riser buoys.

26. The method of claim 25, further comprising the step of producing fluids from the second common riser.

27. The method of claim 25, further comprising the step of producing fluids through the first flowline and the second flowline, each having distal ends that are connected to form a pigging loop.

28. The method of claim 27, wherein the manifold comprises one or more valves operatively connected to the first and second flowlines to control the flow of producing fluids through the pigging loop.

29. The method of claim 25, further comprising the step of producing fluids through two or more jumpers, each jumper interconnecting a subsea tree and the first flowline.

30. The method of claim 25, further comprising the step of producing fluids through two or more jumpers, each jumper interconnecting a subsea tree and the first flowline and the second flowline.

31. The method of claim 30, further comprising the step of producing fluids through one or more jumper valves for controlling the flow of fluid to or from the subsea trees to the first flowline and the second flowline.

32. The method of claim 29 or 30, further comprising the step of producing fluids through jumpers that are arranged in a pattern that corresponds to a pattern of subsea wells.

33. The method of claim 25 or 26, further comprising the step of producing fluids through at least one riser.

34. A subsea manifold system for producing hydrocarbons from a subsea well, the system comprising:

a) two or more subsea trees, each subsea tree connected to a subsea well;

b) a manifold connected to each of the subsea trees;

c) a first common riser having a first flowline connecting the manifold to a vertical riser portion of the first common riser, the first common riser further comprising a first hybrid riser buoy and a flexible jumper interconnecting the first hybrid riser buoy and a disconnectable buoy capable of connecting to a floating vessel; wherein production, maintenance and workover of each subsea well is through the first common riser; and d) a second common riser having a second flowline connected to the manifold, a second hybrid riser buoy and a flexible jumper interconnecting the second hybrid riser buoy of the second common riser and the disconnectable buoy;

wherein the first and second common risers are supported by said first and second hybrid riser buoys without the aid of the disconnectable buoy and the flexible jumpers horizontally balance the disconnectable buoy between the first and second hybrid riser buoys.

* * * * *

UNITED STATES PATENT AND TRADEMARK OFFICE

CERTIFICATE OF CORRECTION

PATENT NO. : 7,793,724 B2
APPLICATION NO. : 11/567637
DATED : September 14, 2010
INVENTOR(S) : Jeremiah Daniel et al.

It is certified that error appears in the above-identified patent and that said Letters Patent is hereby corrected as shown below:

Title Page

Item (73) Assignee: "Chevron U.S.A. Inc., San Ramon, CA (US)"
should read --Chevron U.S.A. Inc., San Ramon, CA (US);
and Technip USA, Inc., Houston, TX (US)--

Signed and Sealed this
Eighteenth Day of January, 2011

David J. Kappos

David J. Kappos
*Director of the United States Patent and Trademark Office*